US005759018A

United States Patent [19]

Thanscheidt

[11] Patent Number: 5,759,018

[45] Date of Patent: Jun. 2, 1998

[54] DEVICE FOR CREATING PRESSURE

[75] Inventor: Gunter Thanscheidt, Hilden, Germany

[73] Assignee: itm, Ute Thanscheidt, Hilden, Germany

[21] Appl. No.: 645,683

[22] Filed: May 14, 1996

[30] Foreign Application Priority Data

May 15, 1995 [DE] Germany ..... 195 18 242.1

[51] Int. Cl.[6] ..... F04B 33/00; F04B 25/04

[52] U.S. Cl. ..... 417/531

[58] Field of Search ..... 92/58.1; 417/531, 417/556, 523, 534

[56] References Cited

U.S. PATENT DOCUMENTS 441,402 11/1890 Eby ..... 417/523
670,811 3/1901 Phelps ..... 92/58.1
1,621,978 3/1927 Formway et al. ..... 417/534
5,676,529 10/1997 Hermansen et al. ..... 417/259

*Primary Examiner*—Timothy Thorpe
*Assistant Examiner*—Ehud Gartenberg
*Attorney, Agent, or Firm*—Collard & Roe,P.C.

[57] ABSTRACT

The invention relates to a device 1 for creating pressure, especially for use as an air pump or a standing compressor, with a stepped housing which is provided with at least one valve connection and whereby a first 8 and a second pressure chamber 61, 62 form a part of the housing's interior; the volume of the former can be altered by a piston and a seal 60 which is effective in only one direction connects the pressure chambers 8, 61, 62. It is proposed that the disadvantages of the known devices, a considerable expenditure of energy being necessary to obtain the final pressure, can be eliminated in that the second pressure chamber comprises two individual pressure chamber sections 61, 62 which are coaxial to the first pressure chamber 8 and which are in a working connection.

15 Claims, 10 Drawing Sheets

Section II-II

Figure 1:
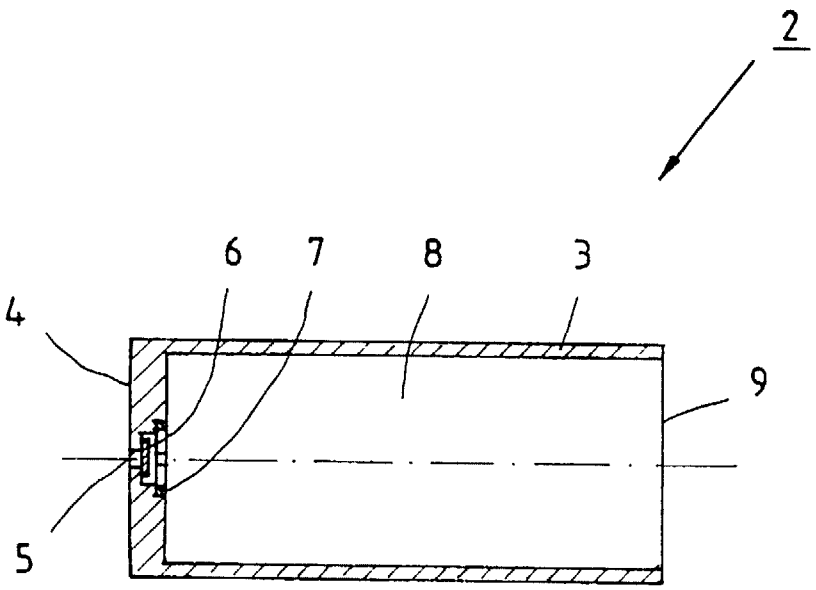

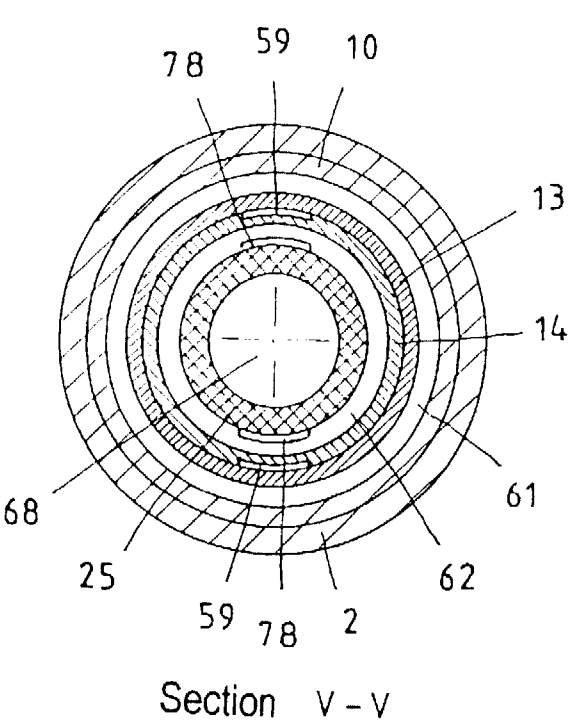
Section V - V
Fig. 9C
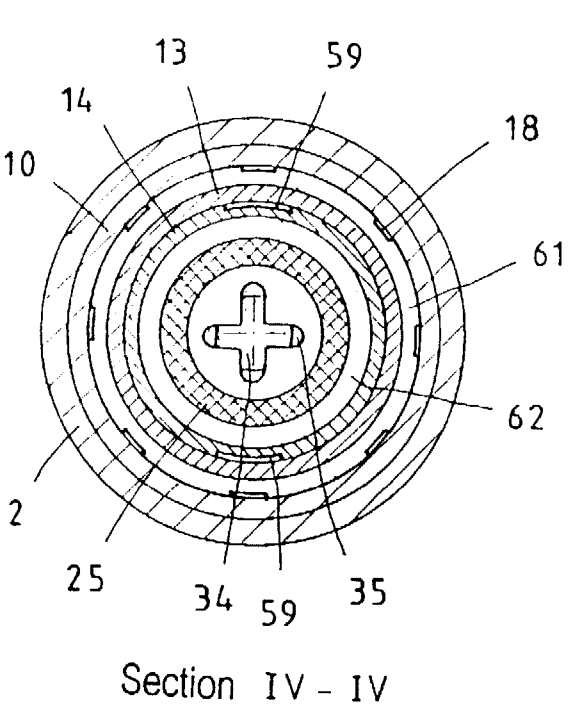
Section IV - IV
Fig. 9B
Fig. 9A
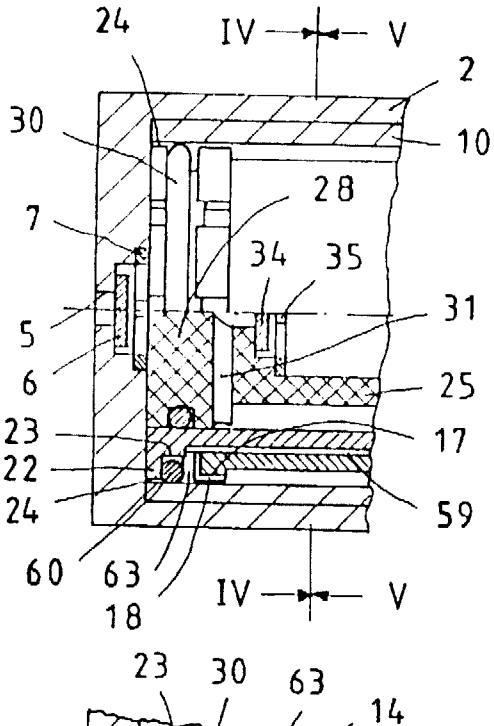
Fig. 9D

DEVICE FOR CREATING PRESSURE

The invention relates to a device for creating pressure, especially for use as an air pump or a standing compressor, with a stepped housing provided with a valve connection, whereby the housing contains at least a first and a second pressure chamber, the volume of which can be altered by means of a piston and which are connected via a seal which is effective in only one direction of movement.

Many different types of devices designed to create pressure, e.g., water, oil or air pressure, are employed and needed in both private homes and industry. The best known design of the device designed to create pressure described above is, e.g., an air pump, which is used to increase the air pressure in bicycle tires, whereby different connection valves are employed depending on the purpose. Normally, Schrader valves are used for motorized vehicles or other vehicles with tires, while bicycle tires are provided with a Dunlop or Sclaverand valve. The amount of pressure depends principally on the type of vehicle and the load, whereby a corresponding amount of energy must be expended to compress the air. The tires of a bicycle are normally pumped to a pressure of three to six bar, those of a motorized vehicle to two to three bar, and those of a racing bicycle to up to eight bar, so that obtaining the desired pressure with a hand-operated device is possible only with additional technical aid. Commercially available air pumps comprise either a single-step version provided with solely one pressure chamber and one piston which compresses air when pushed in and transmits the air to the tire through a seal and a connection valve, or a two-step version which is provided with a first pressure chamber for pre-compressing the air and a connected second pressure chamber in which the air is compressed to obtain the maximum final pressure. Due to the large volume of the first version's pressure chamber, a long stroke re wiring solely a small amount of expended energy is required and a correspondingly large amount of energy is required to obtain the final pressure, whereby the expenditure of energy necessary to compress the air in the pressure chamber increases constantly. With the second version, on the other hand, a small amount of energy is required since the volume of both pressure chambers is smaller and they work alternately; in spite of this fact, the energy required to obtain the final pressure increases constantly and can exceed the strength of, e.g., a child or an older person. In this case, the energy required is primarily determined by the piston area and the volume of the pressure chamber.

The purpose of the invention is to create a device for creating pressure with which a higher final pressure of up to eight bar can be obtained with less expenditure of energy.

This purpose is fulfilled according to the invention in that the second pressure chamber comprises two separate pressure chamber sections which are coaxially arranged in relation to the first pressure chamber and which are connected in a working connection via a connecting channel.

The division of the second pressure chamber into two sections in which the medium is compressed to the highest maximum pressure leads to a design with two pistons which are approximately half the size of single piston. The design using two pistons and reducing the piston area reduces the amount of energy which must he expended in producing the final pressure; furthermore, the expenditure of energy remains the same along the entire length of the stroke as only one of the piston areas compresses the medium and the pressure in both sections of the pressure chamber is increased continuously as a result of compensation in both pressure chamber sections, thereby achieving a considerably higher final pressure and resulting in the fact that the device can be used by a person possessing much less strength.

The axial and radial size of the pump can be kept as small as possible by arranging the pressure chamber in such a way that when the piston is pushed in, both pressure chamber sections are arranged coaxially and possess their greatest amount of volume and the first pressure chamber has the lesser volume, and both sections possess the least amount of volume and the first pressure chamber has the greater volume when in the outward position.

In a further embodiment of the invention, the walls of the pressure chambers comprise several coaxial sleeves which can be nested, whereby the sleeves comprise part of the stepped housing and the pressure chambers are located between the individual sleeves.

In an outstanding embodiment of the invention, the center sleeve which separates the first pressure chamber from the two pressure chamber sections is double-walled and provided with at least one axial connecting channel between the two physically separated sections. One the one hand, the compensation of pressure between the two sections is ensured by the connecting channel of the double-walled center sleeve and, on the other hand, the radial size is not affected.

The size can be reduced further and the maximum pressurized volume can be exploited in that the sleeves are provided with an internal or external collar or a ring-shaped projection on at least one end which functions as the piston in the coaxial neighboring pressure chamber. The respective collar or projection glides on the inner or outer surface of the neighboring sleeve and is optionally sealed off by a sealing ring, e.g., an O-ring, so that a nested cylindrical arrangement of sleeves is created, whereby the pressure chambers are formed between the individual sleeves. The collars or projections can form one piece with the sleeves or be screwed, cemented or welded onto them.

When the two-step method is used, the expenditure of energy is reduced in that both sections of the pressure chamber are compressed when the medium exits through the valve connection under increased pressure at the same time that the medium is drawn into the first pressure chamber.

A connection is created between the two different pressure chambers during pre-compression or the pressure chambers are sealed off from one another during compression in the second pressure chamber in that the seal between the first pressure chamber and the two sections comprises a floating O-ring which seals the first pressure chamber from the two sections through a shift onto a ring-shaped projection when the medium is drawn in and ensures compensation of the pressure while simultaneously compressing the medium in both sections; in the reverse case, the seal between the first pressure chamber and the two pressure chamber sections opens a passage to the second pressurized chamber through a lateral shift into an open space while the medium is being pre-compressed in the first pressure chamber. The shift of the O-ring between the open space and the ring-shaped projection is caused by the reversal of the device and causes both pressure chambers to close or open automatically.

In a further embodiment of the invention, the first pressure chamber is provided with a valve inlet through a one-way valve and the two sections are provided with an outlet leading to the valve connection.

In a further embodiment of the invention, the valve connection extends axially or radially from the stepped housing, whereby the compressed medium can be diverted directly through a valve connection in the outer housing part in a radial arrangement. While a connecting channel in the sleeve nearest the axis is needed with the axial arrangement of the valve connection, such a channel is not necessary in a radial arrangement because the valve connection can attached directly to the outer sleeve or form one piece with it.

The center sleeve can be manufactured at low cost as it comprises two parts which are then screwed or cemented together. An additional seal can be obtained between the individual sleeves by locating a groove with an O-ring or a lip seal between the individual sleeves.

A variety of uses for the device is possible in that the valve outflow from both sections passes through an adapter housing which represents a multifunction connection. The adapter housing is also provided with a number of valve connections which can be connected to the second pressure chamber or the sections optionally and individually via a sealing element.

Figure 2:
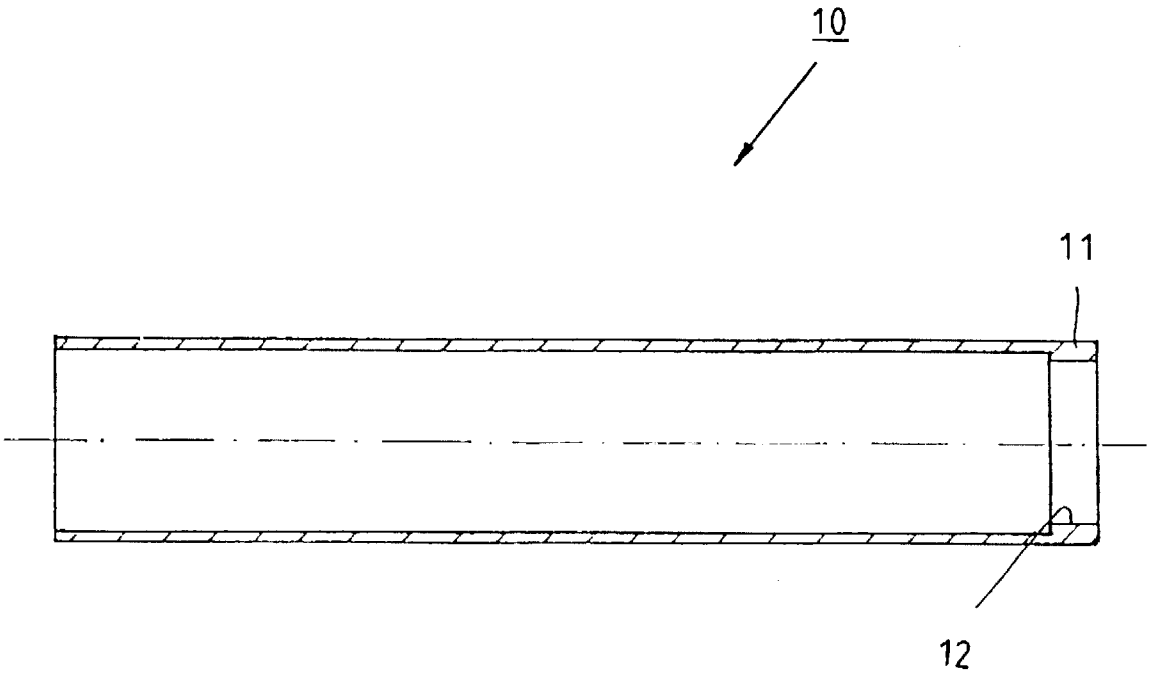
Figure 3:
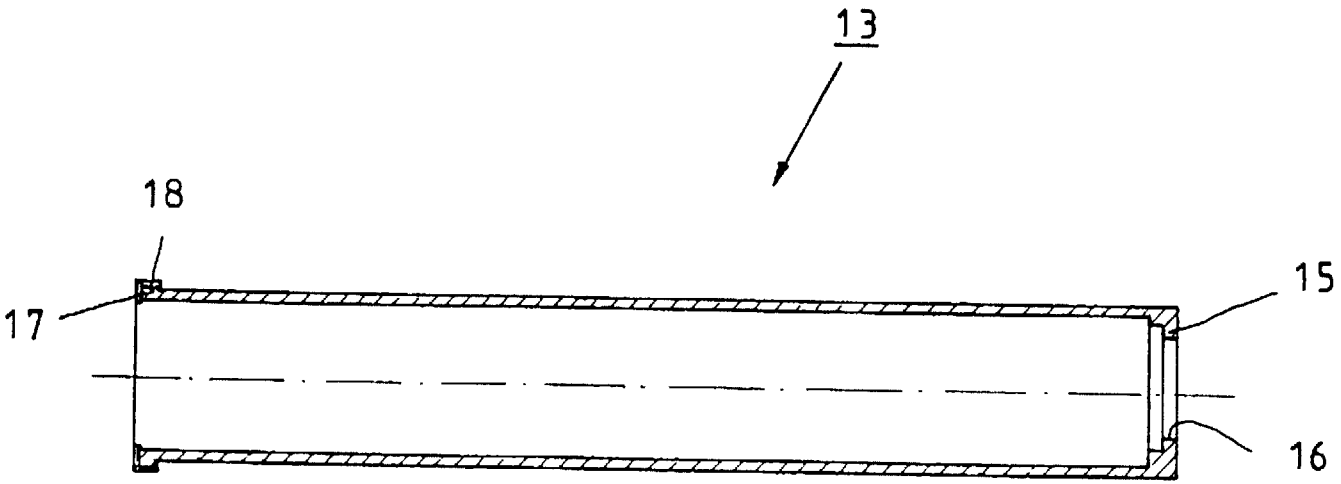
Figure 4:
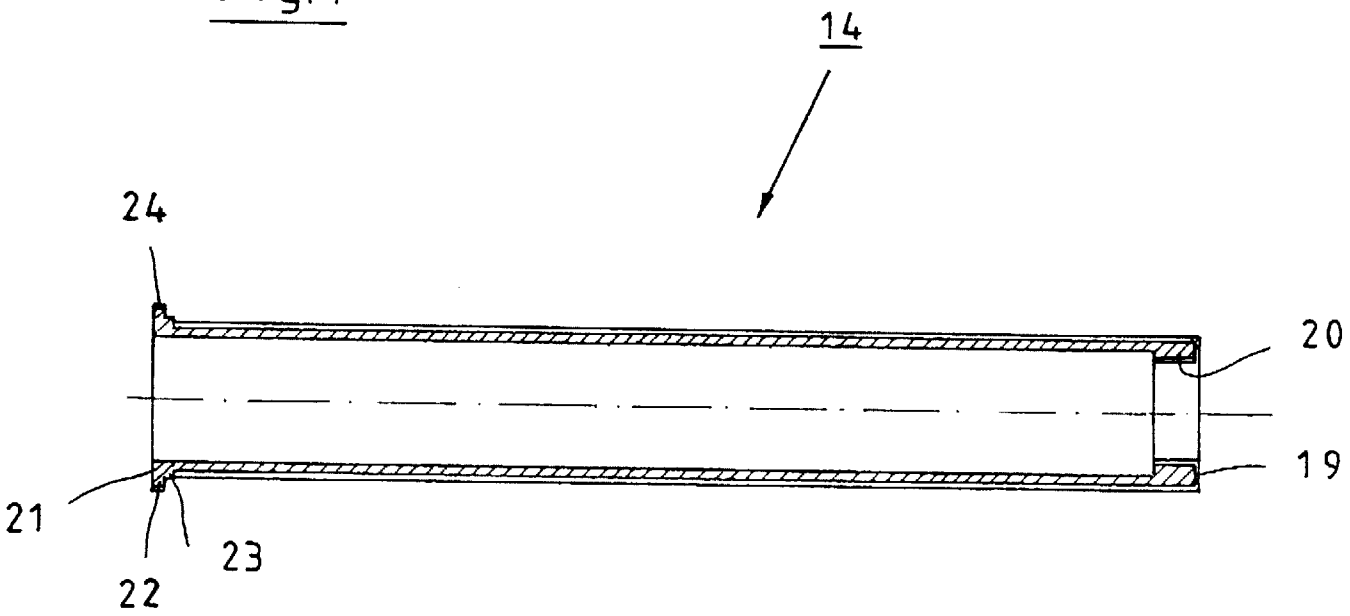
Figure 5:
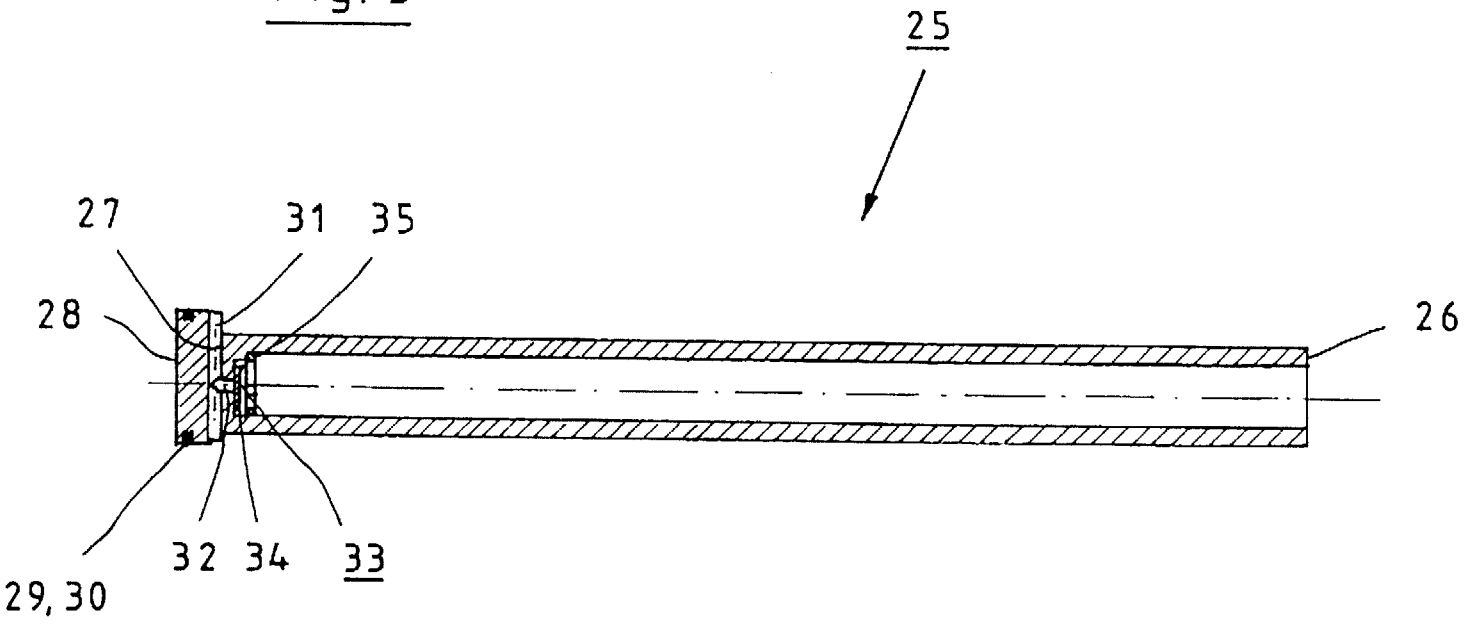
Figure 6B:
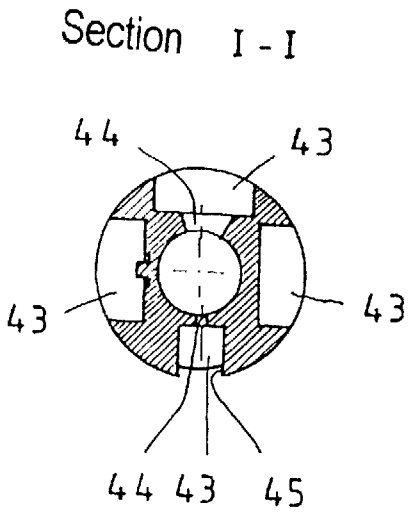
Figure 6A:
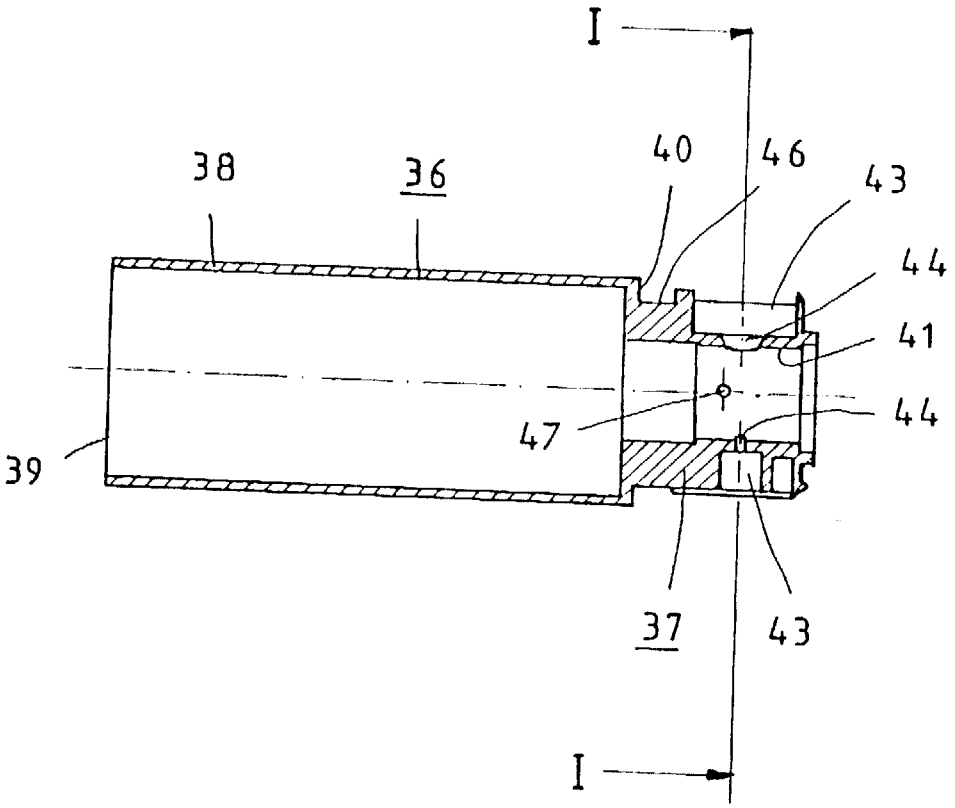
Figure 7B:
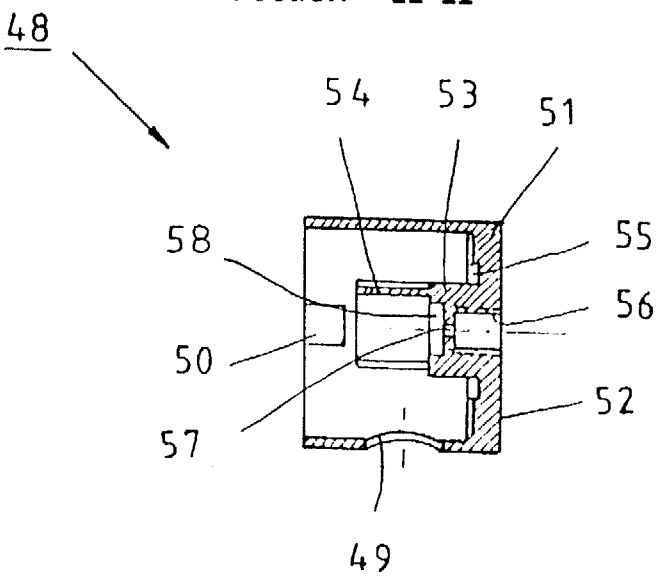
Figure 7A:
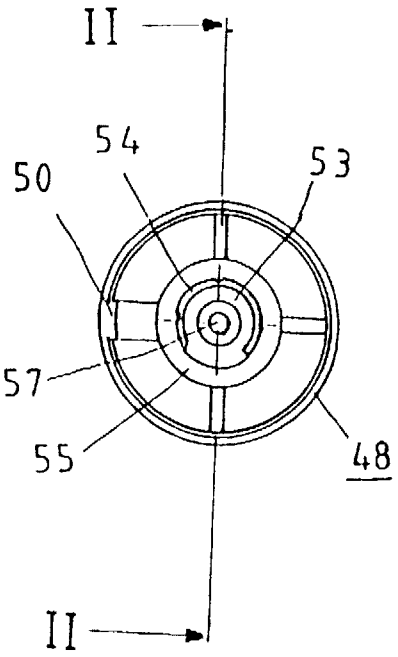
Figures 8A, 8B:
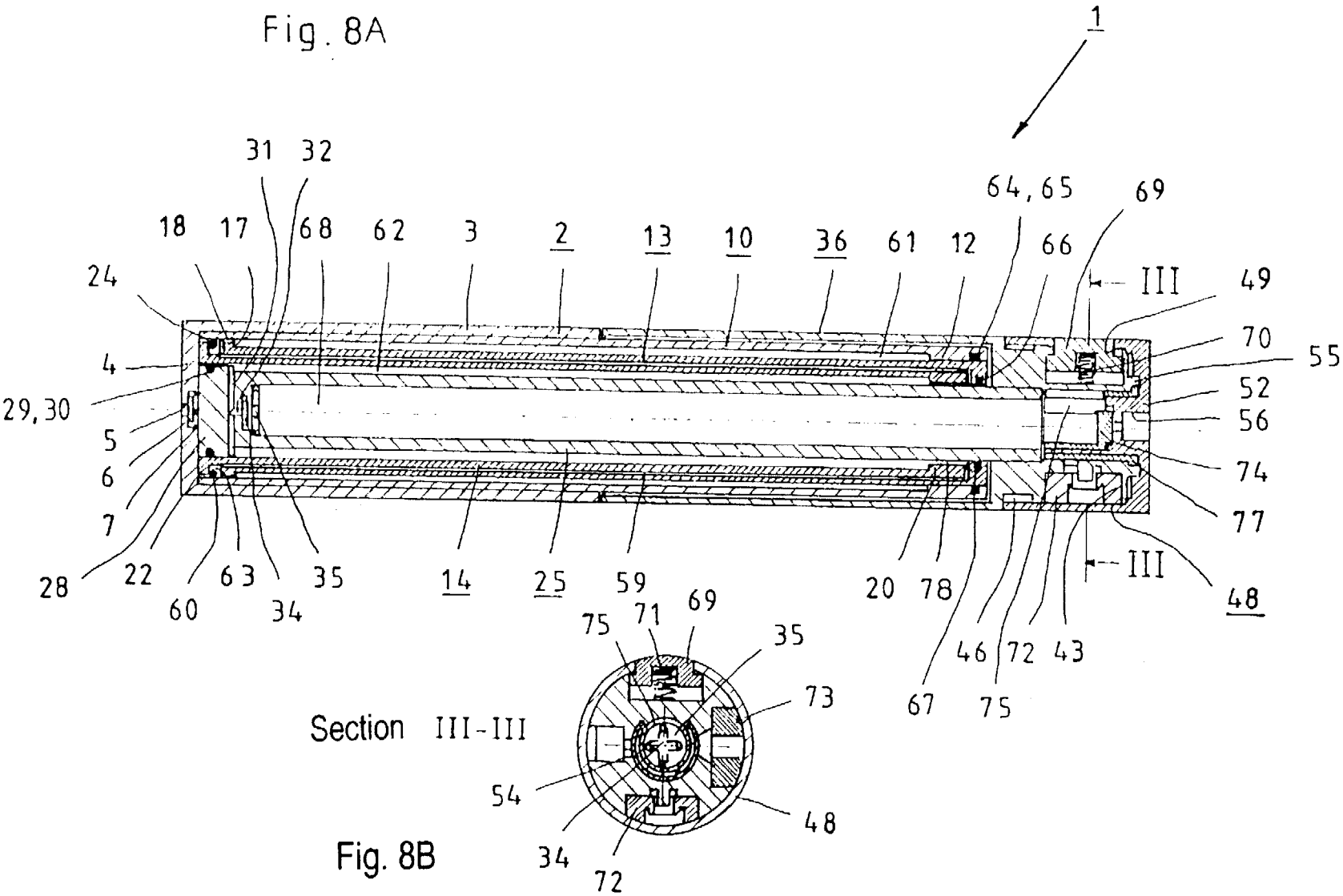
Figure 10:
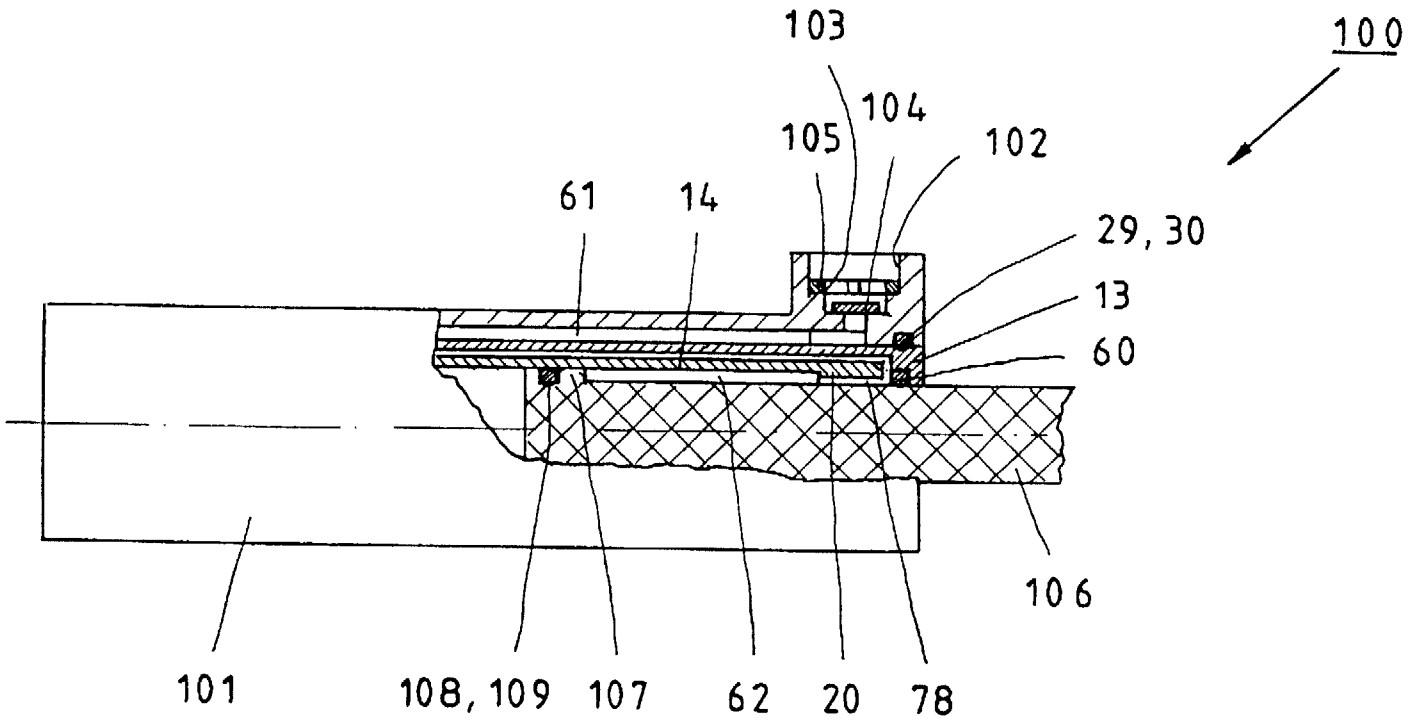

The invention is described in greater detail in the figures. The following is shown:

FIG. 1 a gripping cap on the device in a sectional side view;

FIG. 2 a cylindrical sleeve designed to he received by the gripping cap in a sectional side view;

FIG. 3 the first section of a piston cylinder sleeve in a sectional side view;

FIG. 4 the second section of a piston cylinder sleeve in a sectional side view;

FIG. 5 a piston sleeve in a sectional side view;

FIG. 6 a gripping piston sleeve in a sectional side view with an adapter housing which forms a part of it and in a section I—I;

FIG. 7 a sleeve in a sectional side view and in a section II—II for the adapter housing;

FIG. 8 a device after assembly in a sectional side view and a section along the connecting line III—III;

FIG. 9 two enlarged partial views of the device and a section along the connecting lines IV—IV and V—V; and FIG. 10 a second embodiment of the pump device in a partially cutaway side view.

The FIGS. 1 to 6 show the various individual components of a device 1 for creating pressure as shown in FIG. 7 after assembly and for use as, e.g., an air pump.

FIG. 1 shows a gripping cap 2 comprising a cylindrical sleeve 3 with a closed front wall 4. A seal comprising a valve plate 6 and a valve bracket 7 which fixes the valve plate in the front wall 4 is set in the front wall 4 in a stepped bored hole 5. The external air passes through the stepped bored hole 5 when drawn into the first pressure chamber of the device 1, whereby the valve plate 6 functions as a return valve and is provided with axial play for the purpose of exposing the stepped bored hole 5. During compression, on the other hand, the valve plate 6 is pressed against the step of the stepped bored hole 5 of lesser diameter and closes the first pressure chamber 8, which is located inside the sleeve 3, to the surrounding external air. Using a type of seal other than the valve plate 6 is conceivable. The cylindrical sleeve shown in FIG. 2 is inserted into the open end 9 of the gripping cap 2, and this sleeve is closed by additional sleeves or a gripping piston sleeve.

FIG. 2 shows a cylindrical sleeve 10 which is employed as an external intermediate sleeve of the telescoping device 1. One end 11 of the cylindrical sleeve 10 is provided with a ring-shaped projection 12 facing inward which functions as both a guide of the piston cylinder sleeve and a radial termination which closes off the first of the two pressure chamber sections together with the coaxial piston cylinder sleeve, as is shown in FIGS. 3 and 4.

The piston cylinder sleeve comprises two parts 13, 14 which are shown in FIGS. 3 and 4. FIG. 3 shows the first part 13 of the piston cylinder sleeve 10, which is inserted into the cylinder sleeve 10 during assembly in such a way that the protruding ends face in opposite directions. The first part 13 of the piston cylinder sleeve 10 comprises a tubular piece which is partially closed on one end by a front wall 15. The front wall 15 is provided with a two-step bored hole 16, and the step of larger diameter is intended to receive the part 14 of the piston cylinder sleeve while the step of the stepped bored hole 16 of lesser diameter receives a second piston sleeve as shown in FIG. 5. The opposite end of the first part 13 of the piston cylinder sleeve is open and provided with an outer radial projection 17 around the circumference of which several channels 18 are distributed.

FIG. 4 shows the second part 14 of the piston cylinder sleeve, which is inserted into the first part 13 during assembly. The end 19 of the second part 14 of the piston cylinder sleeve is provided with a ring-shaped projection 20 pointing inwards with an inner diameter which corresponds to the outer diameter of the piston sleeve shown in FIG. 5. At the same time, the projection 20 functions as the piston for the pressure chamber section formed in the space between the piston cylinder sleeve and the piston sleeve. The opposite end 21 of the second part 14 of the piston cylinder sleeve is provided with a projection 22 which points outward, the outer diameter of which corresponds to the outer diameter of the projection 17 of the first part 13 and which is inserted into the cylinder sleeve 10 after assembly. The other end 21 of the piston cylinder sleeve is open and receives the piston sleeve shown in FIG. 5. A ring-shaped projection 23 is located behind the projection 22 on the outer shell of the piston cylinder sleeve 13 and provided with a floating O-ring with axial play which functions as a sealing element between the first and second. Both parts 13, 14 of the piston cylinder sleeve are nested and, e.g., cemented, welded or screwed together, whereby the inner piston cylinder sleeve protrudes past the outer part 13 of the piston cylinder sleeve and leads between the axes of the projections 17 and 22 on the O-ring after assembly. Just as with the projection 17, the projection 22 is provided with channels 24 distributed around its circumference which compensate the pressure between the two pressure chambers to the extent that the O-ring does not create a seal. A seal is always created between the O-ring and the two pressure chambers when air is drawn into the first pressure chamber, and the creation of this seal is prevented when the air is pre-compressed in the first pressure chamber. Regardless of the position of the O-ring, a working connection between the two pressure chamber sections is created by at least one connecting channel 59 in the form of a longitudinal groove located on the outer circumference of the second part 14 of the piston cylinder sleeve, which is always open.

FIG. 5 shows a piston sleeve 25 which can be inserted into the interior part 14 of the piston cylinder sleeve. The piston sleeve 25 is provided with an open end 26 which is cemented, screwed or welded in place in a bored hole in the gripping piston sleeve as shown in FIG. 6. The other end 27 is also open and is closed off by a piston ring 28 which is inserted into the piston sleeve 25 with a projection and cemented, welded or screwed to it. The outer circumference of the piston ring 28 is provided with a groove 29 with an O-ring 30 which seals the inner part 14 of the piston cylinder sleeve after assembly. The air is fed through the bored hole in the piston sleeve 25 to a valve connection as is provided, e.g., in the gripping piston sleeve from FIG. 6. Furthermore, the piston ring 28 behind the O-ring 30 is provided with a radial connecting channel 31 which points toward the piston sleeve 25, which is connected to an axial bored hole 32 which is in turn connected to the interior of the piston sleeve. 25. The seal is a one-way seal which permits the air to exit in the direction of the valve connection and which closes the bored hole 32 automatically in the presence of corresponding counterpressure. The seal comprises an elastic valve plate 33 and a valve holder 34 which fixes the valve plate 33 in the bored hole 32 axially. Alternately, a different type of one-way valve can also be employed.

FIG. 6 shows a gripping piston sleeve 36 and an adapter housing 37 in a sectional side view and along the section I—I. The adapter housing 37 is connected to the gripping piston sleeve 36 of the device in one piece. Alternately, two separate pieces which are then cemented or welded together can also be used. The gripping piston sleeve 36 comprises a hollow cylindrical section 38 with one open end 39 into which the cylinder sleeve 10 can be inserted. The adapter housing 37 forms one piece with the gripping piston sleeve 36 at its other end 40, and this housing 37 comprises a ring-shaped projection provided with several bored holes or openings. An axial bored hole 41 terminates in the cylindrical section 38 of the gripping piston sleeve 36, whereby the rear of the bored hole 41 is provided with a relatively large step into which the open end 26 of the piston sleeve 25 can be inserted. The piston sleeve 25 is also cemented or welded to the adapter housing 37 for the purpose of creating an effective seal. As can be seen in the section I—I, a total of four recesses 43 are incorporated into the adapter housing 37. These recesses are arranged at 90° angles to one another. Placing a larger number of recesses 43 around the circumference of the adapter housing 37 is also conceivable. The rear of the recesses 43 are square or circular, whereby three of the recesses 37 are connected to the central bored hole 41 via a connecting channel 44. The size of the recesses 43 and that of the connecting channel 44 correspond to the various types of valve connections, whereby a suitable rubber seal is inserted into each recess 43 during assembly. Depending on the type of valve connection used, the connecting channel 44 comprises a small bored hole or a larger opening which permits the insertion of the valve stem to the inner bored hole 41, permitting a reduction in the size of the device 1 or the adapter housing 37. On the other hand, the fourth recess 43 is not connected to the central bored hole 41 because a push-button which permits locking of the adapter housing 37 is inserted into this recess 43. The accumulation of dirt and the entrance of dirt particles into the pressure chambers is prevented when the push-button is in the locked position and the various outlets are closed off by the sleeve shown in FIG. 7. Furthermore, a longitudinal groove 45 and a snap ring groove 46 which guide one of the projections forming a part of the sleeve are incorporated into the adapter housing 37. The sleeve can be pushed through the longitudinal groove 45 with the projection and turned to any desired position, whereby the position can be fixed by a projection 47 which forms part of the adapter housing 37. The projection 47 penetrates a star-shaped groove in the sleeve for the purpose fixing the position.

FIG. 7 shows an overhead view and a sectional side view II—II of a sleeve 48 which can slid onto the adapter housing 37 coaxially. The sleeve 48 is provided with an opening 49 which exposes one of the recesses 43 or permits the locking button to catch, depending on the turned position of the sleeve 48. A projection 50 which forms part of the inner side of the sleeve 48 leads through the longitudinal groove 45 or the snap ring groove 46 on the adapter housing 37. The projection 50 prevents the sleeve 48 from being removed from the adapter housing 37 unless turned to a certain position. The end of the sleeve 48 facing away from the projection 50 is closed off by a wall 51 with a front face 52. A circular projection 53 which forms a part of the inner side of the wall 51 is extended by a segmental ring projection 54. The segmental ring projection 54 extends over approximately a three-quarter circle, and its opening is aligned with the opening 49 on the sleeve 48. A sealing element is slid onto the segmental ring projection 54 and used to seal the various outlets. A groove 55 on the wall 52 which receives the ring-shaped collar of the sealing element surrounds the projection 53. A central bored hole 56 which extends into the projection 53 and which is connected to the bored hole 56 in the segmental ring projection 54 via a small connecting channel 57 is located on the front face 53. Furthermore, a recess 58 designed to receive a seal for the bored hole 56 is incorporated into the projection 53. The bored hole 56 is sealed off from the two pressure chamber sections by the seal and receives, e.g., a hose connection, with which connections to additional valve connections which may not be easily accessible can be created.

FIG. 8 shows a sectional side view and a section III—III of the device 1 after assembly, and FIG. 9 shows two sectional partial views of the floating O-ring 60 in two different positions as well as the radial arrangement of the sleeves in two sectional overhead views.

The outer parts of the device comprise the gripping cap 2 and the gripping piston sleeve 36 with the adapter housing 37 which forms a part of it and which is closed off by the coaxial sleeve 48 or which permits the selection of one of the outlets. In addition, the first part 13 of the piston cylinder sleeve and the piston sleeve 25 are exposed when the device 1 is extended. The sleeves are coaxial when the device 1 is retracted, whereby the cylinder sleeve 10, the two-piece piston cylinder sleeve 13, 14 and the piston sleeve 25 succeed the gripping cap 2 and the gripping piston sleeve 36 from the exterior to the interior. The front face 4 of the gripping cap 2 is provided with a stepped bored hole 5 with a valve plate 6 and a valve holder 7 which draw the external air into the first pressure chamber. The first pressure chamber, however, is not visible in the retracted position; it is exposed between the piston ring 28 and the inner side of the front face 4 when the device 1 is extended and its radius is delimited by the cylinder sleeve 10. The first pressure chamber is sealed firstly by a groove 29 with an O-ring 30 located in the piston ring 28, and secondly, a floating O-ring which is shifted onto a ring-shaped projection 23 when the device 1 is extended is also provided for this purpose and closes off the channel or channels 24 between the first pressure chamber and the two pressure chamber sections 61, 62. When the device 1 is pressed together, on the other hand, the O-ring 60 is shifted axially into a ring-shaped open space 63 so that a connection is created between the first pressure chamber and the two pressure chamber sections 61, 62 via the channel 24 and the two connecting channel 58 as well as a channel 78, while the first pressure chamber is sealed off from the exterior by the valve plate 6 and pre-compression is made possible. When the air is pre-compressed, it simultaneously flows through both the channel 24 and the connecting channel 59 as well as through at least one additional channel 78 which forms part of the inner surface of the projection 20 on the second part 14 of the piston cylinder sleeve, into both of the second pressure chamber sections 61, 62, which are located between the cylinder sleeve 10 and the first part 13 of the piston cylinder sleeve on the one hand and between the second part 14 of the piston cylinder sleeve and the piston sleeve 25 on the other hand. The radii of both of the pressure chamber sections 61, 62 are closed or sealed by the projection 12 on the cylinder sleeve 10 and the outer radial projection 22 on the second part 14 of the piston cylinder sleeve with the O-ring 60 when the external air is drawn in or by the internal radial projection 20 of the second part 14 of the piston cylinder sleeve and the first part 13 of the first part 13 of the piston cylinder sleeve and the piston ring 28, whereby an internal groove 64 with an O-ring 60 is provided in the projection 12 and an internal groove 66 with an O-ring 67 is provided in the front face 15 for the purpose of creating a better seal. The bored hole 16 and the radial projections 12, 20 as well as the projections 17, 22 respectively guide the coaxial neighboring sleeves, whereby the projections 12, 20 and 22 with the O-ring 60 simultaneously function as the piston in the pressure chamber sections 61, 62 and enable the compression of air in both pressure chamber sections 61, 62. The pressure chamber section 62 is connected to the interior 68 of the piston sleeve 25 via a connecting channel 31 and a bored hole 32, and the open end of the piston sleeve 25 terminates in the bored hole 41 in the adapter housing 37. The bored hole can be closed by means of a one-way valve in the form of a valve plate 34 and a valve holder 35 to prevent the ejected air from reentering; when the air is compressed in both pressure chamber sections 61, 62, this one-way valve opens due to the overpressure, thereby permitting the air to exit to the adapter housing 37. Compression always takes place in both pressure chamber sections 61, 62 when the device 1 is extended and the external air can simultaneously flow into the first pressure chamber.

The adapter housing 37 of the device 1 is shown after assembly in a section III—III. In this drawing, one can recognize that a push-button 69 with a spring 71 located in a blind bored hole 70 has been provided in the recesses 43 on the adapter housing 37 in the upper position, while a seal 72 or 73 has been placed in the lower right recess 43. The left recess 43 is, on the other hand, open and receives a separate adapter. The opening 49 faces upward in the turned position of the sleeve 48 so that the push-button 69 can be pressed outward through the opening 49 by the spring 71. The seals 72, 73 are additionally closed off by the sleeve 48 for the purpose of preventing the accumulation of dirt and represent the locking position of the device 1 in which none of the outlets are connected to the pressure chamber sections 61, 62. A seal from the pressure chamber sections 61, 62 is created by a sealing element 74 which is shifted upward on the segmental ring projection 54 of the sleeve 48 and which faces the push-button 69 segmental cutout. When the sleeve 48 is turned, the segmental ring projection 54 which forms one piece with the sleeve 48 turns also so that the segmental cutout 75 of the sealing element 78 is turned toward the outlets and a connection is simultaneously created to the pressure chamber sections 61, 62. The bored hole 56 located in the front face 52 is sealed by the front face 76 of the sealing element 74 so that only a single sealing element 74 is required for all the outlets in the adapter housing 37. Alternately, the bored hole 56 can be sealed off by a separate seal. The seal can pressed inward by an extended projection of a connectable adapter or a manometer so that a connection to the pressure chamber sections 61, 62 is created. The sealing element 74 itself is shifted onto the ring-shaped projection 53 on the sleeve 48 and lies with its collar 77 in the ring-shaped groove 55 so that the pressure chamber sections 61, 62 are sufficiently sealed of from the sleeve 48.

The position of the O-ring 60 is again visible in FIG. 9 in an enlarged and sectional partial view of the device 1 in a position in which it provides a seal in the upper drawing and in an open position in the lower drawing. The O-ring 60 is provided with axial play and can shift from the sealing position on the ring-shaped projection 23 on the second part 14 of the piston cylinder sleeve, which is reached when the device is extended, to the open space 63 in an opening position when the device 1 is retracted. The channel 24 is exposed for the connection of the pressure chambers 8 or 61, 62 in the opening position.

The radial arrangement of the sleeves and that of the connecting channels running between the pressure chambers 8 or 61, 62 are shown individually in the sections IV—IV and V—V. Furthermore, the channels 18, the connecting channels 59 and the channel 78 which permit compensation of the pressure between the two pressure chamber sections 61, 62 are visible in the sectional drawings.

FIG. 10 shows a sectional partial view of a further embodiment of the invention in the form of a device 100 which is used as a standing compressor and which is provided with the following deviations from the previously described embodiments. The device 100 is provided with a single outlet which forms one radial piece with an external cylinder sleeve 101, whereby the outlet is provided with a recess 102 which is directly connected to a pressure chamber section 61 by a stepped bored hole 103, whereby a one-way valve comprising a valve plate 104 and a valve holder 105 and located in the center of the stepped bored hole 103 provides a seal. The connecting channel to the adapter housing is made unnecessary as the outlet is located directly on the cylinder sleeve 101, so that the piston sleeve 25 can be replaced by a piston rod 106 which is provided with a projection 107 with a groove 108 and an O-ring 109 for the purpose of providing a seal. The remaining technical features correspond to those of the device 1.

I claim:

1. A device for creating pressure, especially for use as an air pump or a standing compressor, with a stepped housing provided with a valve connection and whereby the housing contains at least a first and a second pressure chamber, the volume of which can be altered and which are connected by a seal which is effective in only one direction, characterized in that the second pressure chamber comprises at least two individual pressure chamber sections (61, 62) which are coaxial to the first pressure chamber (8) and which are connected by a connecting channel (18, 59, 78) in a working connection.

2. A device as claimed in claim 1, characterized in that the two pressure chamber sections (61, 62) are coaxial and contain their greatest volume and the first pressure chamber (8) contains the least volume when the device is retracted.

3. A device as claimed in claim 1, characterized in that the two pressure chamber sections (61, 62) contain their smallest amount of volume and the first pressure chamber (8) contains the greater volume when the device is extended.

4. A device as claimed in claim 1, characterized in that the walls of the pressure chamber sections (8, 61, 62) comprise several coaxial sleeves (2, 10, 13, 14, 25) which can be nested, whereby the sleeves (2, 10, 13, 14, 25) form part of the stepped housing.

5. A device as claimed in claim 4, characterized in that the center sleeve (13, 14) which separates the first pressure chamber (8) from the two pressure chamber sections (61, 62) is provided with a double wall and at least one axial connecting channel (59) which connects the two physically separated pressure chamber sections (61, 62).

6. A device as claimed in claim 4, characterized in that at least one end of the sleeves (2, 10, 13, 14, 25, 106) is provided with an internal or external collar or ring-shaped projection (12, 17, 20, 22, 107) which functions as the piston in the coaxial neighboring pressure chambers (8, 61, 62).

7. A device as claimed in claim 6, characterized in that the collars or projections (12, 17, 20, 22, 107) form one piece with the sleeves (10, 13, 14, 25, 106) or are screwed, cemented or welded to them.

8. A device as claimed in claim 1, characterized in that the two pressure chamber sections (61, 62) are compressed and the medium simultaneously exits through the valve connection under increased pressure when the medium is drawn into the first pressure chamber (8).

9. A device as claimed in claim 1, characterized in that the seal between the first pressure chamber (8) and the two pressure chamber sections (61, 62) comprises a floating O-ring (60) which seals off the first pressure chamber (8) from the two pressure chamber sections (61, 62) when the medium is drawn in by shifting to a ring-shaped projection (23) and which ensures compensation of the pressure when the medium is simultaneously compressed in both pressure chamber sections (61, 62).

10. A device as claimed in claim 1, characterized in that the seal between the first pressure chamber (8) and the two pressure chamber sections (61, 62) comprises a floating O-ring (60) which creates an opening to the second pressure chamber or the two pressure chamber sections (61, 62) by shifting laterally into an open space (63) when the medium is pre-compressed in the first pressure chamber (8).

11. A device as claimed in claim 1, characterized in that the first pressure chamber (8) is provided with a valve inlet through a one-way valve (6, 7) and the two pressure chamber sections (61, 62) are provided with an outlet leading to the valve connection.

12. A device as claimed in claim 11, characterized in that the valve connection leads from the stepped housing in an axial or radial direction, whereby the compressed medium can exit directly through a valve connection in the outer housing part (101) in a radial arrangement.

13. A device as claimed in claim 5, characterized in that the central sleeve comprises two parts (13, 14) which are screwed or cemented together.

14. A device as claimed in claim 4, characterized in that a groove (29, 64, 66, 108) with an O-ring (30, 65, 67, 109) or a lip seal is located between the individual sleeves (10, 13, 14, 25, 106).

15. A device as claimed in claim 11, characterized in that the valve outlet of the two pressure chamber sections (61, 62) leads through an adapter housing (37) which represents a multifunction connection and which is provided with several different valve connections which can be connected to the second pressure chamber or the pressure chamber sections (61, 62) optionally and individual by means of a sealing element (74).

* * * * *